US009612560B2

(12) United States Patent
Karn

(10) Patent No.: US 9,612,560 B2
(45) Date of Patent: Apr. 4, 2017

(54) PRINTING SYSTEM METHOD AND APPARATUS FOR COMPARING CALCULATED SHEETS NEEDED AGAINST SHEETS AVAILABLE

(75) Inventor: Keith S. Karn, Avon, NY (US)

(73) Assignee: Xerox Corporation, Norwalk, CT (US)

( * ) Notice: Subject to any disclaimer, the term of this patent is extended or adjusted under 35 U.S.C. 154(b) by 2764 days.

(21) Appl. No.: 11/134,989

(22) Filed: May 23, 2005

(65) Prior Publication Data

US 2006/0263104 A1 Nov. 23, 2006

(51) Int. Cl.
*G03G 15/00* (2006.01)

(52) U.S. Cl.
CPC ..... *G03G 15/553* (2013.01); *G03G 15/5087* (2013.01)

(58) Field of Classification Search
USPC ..... 399/23; 271/9.01, 9.03
See application file for complete search history.

(56) References Cited

U.S. PATENT DOCUMENTS 4,500,199 A * 2/1985 Kasuga et al. ..... 399/23
4,734,747 A * 3/1988 Okuda et al. ..... 399/23
4,835,573 A 5/1989 Rohrer et al.
5,021,826 A * 6/1991 Maruta ..... 399/24
5,129,639 A 7/1992 DeHority
5,604,600 A 2/1997 Webster
5,700,003 A * 12/1997 Sung ..... 271/110
5,710,635 A 1/1998 Webster et al.
5,960,230 A * 9/1999 Peter ..... 399/23
5,991,556 A * 11/1999 Yamashita ..... 399/23
6,700,675 B1 * 3/2004 Yamamoto ..... 358/1.15

* cited by examiner

*Primary Examiner* — Matthew G Marini
(74) *Attorney, Agent, or Firm* — Fay Sharpe LLP

(57) ABSTRACT

A method for a printing system, wherein a print media sheets needed count is compared to a print media sheets available count, includes initiating a print job on an imaging machine through at least one input device communicating with the imaging machine. Information from the at least one input device corresponding to the print job is received. The print job is processed on the imaging machine. A print media sheets needed count for the print job is calculated from the received information from the at least one input device. A print media sheets available count is received representative of a plurality of print media sheets adapted to be fed through the imaging machine. The print media sheets needed count is compared against the print media sheets available.

17 Claims, 4 Drawing Sheets

PRINTING SYSTEM METHOD AND APPARATUS FOR COMPARING CALCULATED SHEETS NEEDED AGAINST SHEETS AVAILABLE

BACKGROUND

Exemplary embodiments disclosed herein generally relate to electrostatographic imaging machines and, more particularly, to a method for comparing calculated sheets needed against sheets available employed in an electrostatographic imaging machine.

In a typical electrostatographic imaging machine, a photoreceptive member is charged, positively or negatively, to a substantially uniform potential so as to sensitize a photoconductive surface thereof. The charged portion of the photoconductive surface is then exposed to a light image representative of a document to be produced. Exposing the charged photoreceptive member to the light image discharges the charged portion of the photoconductive surface in areas corresponding to non-image areas in the document to be produced while maintaining the charge in image areas, thereby creating an electrostatic latent image of the document to be produced on the photoreceptive member. This latent image is subsequently developed into a visible image, corresponding to the informational areas contained within the document to be produced, by depositing oppositely charged developing material onto the photoreceptive member surface such that the developing material is attracted to the charged image areas on the photoconductive surface.

Thereafter, the developing material is transferred from the photoreceptive member to a print media or receiving sheet or to some other image support substrate, to create an image, which may be permanently affixed to the print media sheet, thereby providing an electrophotographic document. In a final step in the process, the photoconductive surface of the photoreceptive member is cleaned with a cleaning device, such as elastomeric cleaning blade, to remove any residual developing material which may be remaining on the surface thereof in preparation for successive imaging cycles.

The electrostatographic process described hereinabove for electrophotographic imaging is well known and is commonly used for light lens copying of an original document. Analogous processes also exist in other electrostatographic printing applications such as, for example, digital laser printing where a latent image is formed on the photoconductive surface via a modulated laser beam, or ionographic printing and reproduction where charge is deposited on a charge retentive surface in response to electronically generated or stored images.

Typically, the information forming the document or documents to be printed is provided to the imaging machine in electronic form or is converted to electronic form by the imaging machine from the original document (or documents). Alternatively, copying of the document can occur without digitizing an original document (i.e., analog copying), such as occurs in some light lens copying applications. The information forming the document to be printed can come from any source, such as, for example, a scanner, a software program, a storage medium, a computer, a network, etc., or some combination of these sources. The document or documents to be printed, whether computer generated or created from an original document to be copied, can be referred to as a print job. In one example, the imaging machine is an all-in-one imaging machine that enables both copying and printing. Such an all-in-one imaging machine can include an integral scanner for converting an original document into electronic form and can include suitable connections for receiving other electronic representations of documents from a source, such as a computer, portable memory device, network, facsimile machine or the like.

For providing the print media sheet, imaging machines often include one or more trays for holding a stack of blank print media sheets. As needed, one sheet of a stack of sheets, usually a top sheet, is fed through the imaging machine for receiving and having permanently affixed thereto the toner, ink or the like, as will be known and understood by those skilled in the art. Heretofore, when a stack of sheets in an imaging machine was depleted, all printing ceased, even if the imaging machine was in the middle of a print job. Thus, regardless of the number of print media sheets necessary for a particular print job, the imaging machine typically started the print job and stopped when no more blank print media sheets were available. Often, the user or customer was first informed of the need for more print media sheets in the imaging machine tray only after stoppage of the print job. This annoying and unproductive stop decreases productivity and requires the user to attend to the imaging machine before the print job can be resumed and completed.

Accordingly, there is a need to eliminate or at least lessen the likelihood of annoying and unproductive stops in print jobs of imaging machines, particularly when the stop is related to an empty print media sheet supply tray and the print job being processed requires additional print media sheets. It would be desirable to inform the user earlier, i.e., before the print job stops, that there is insufficient print media sheets in the imaging machine supply tray to complete the print job so that the user could re-supply the tray prior to the print job stoppage.

SUMMARY OF THE INVENTION

In one exemplary embodiment, a method for a printing system, wherein a print media sheets needed count is compared to a print media sheets available count, includes initiating a print job on an imaging machine through at least one input device communicating with the imaging machine. Information from the at least one input device corresponding to the print job is received. The print job is processed on the imaging machine. A print media sheets needed count for the print job is calculated from the received information from the at least one input device. A print media sheets available count is received representative of a plurality of print media sheets adapted to be fed through the imaging machine. The print media sheets needed count is compared against the print media sheets available.

In another exemplary embodiment, a method for comparing calculated sheets needed against sheets available is provided. More specifically, according to the method of this exemplary embodiment, a print job is initiated on an imaging machine. A print media sheets needed count is calculated for the print job. A print media sheets available count is received from a sensing device representative of a plurality of print media sheets. Whether the print media sheets available count is greater than the print media sheets needed count is determined.

In yet another exemplary embodiment, a printing system is provided that notifies a user when a print media sheets needed count exceeds a print media sheets available count. More particularly, in accordance with this embodiment, the printing system includes an imaging machine operatively connected to a storage member for storing a plurality of print media sheets to be fed during processing of a print job. A sensing device is provided for determining a print media sheets available count from the plurality of print media sheets of the storage member. An electronic subsystem is adapted to receive the print media sheets available count from the sensing device. At least one input device is connected to the electronic subsystem for initiating the print job. The electronic subsystem is adapted to calculate a print media sheets needed count from the print job and compare the print media sheets needed count against the print media sheets available count. At least one output device is connected to the electronic subsystem for notifying a user that the print media sheets needed count exceeds the print media sheets available.

DETAILED DESCRIPTION

Figure 1:
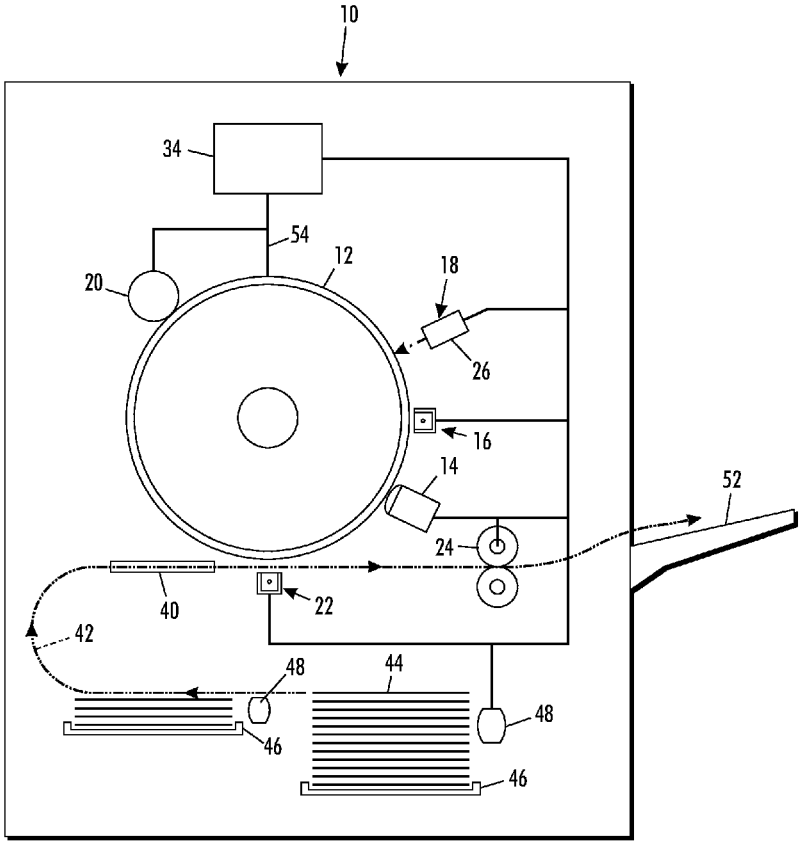
FIG. 1 is a schematic view of a representative electrostatographic imaging machine.

Referring now to the drawings wherein the showings are for purposes of illustrating one or more exemplary embodiments, an electrostatographic imaging machine 10 is schematically shown in FIG. 1 which can employ the method of the present exemplary embodiment. The imaging machine 10 of FIG. 1 includes many of the hardware elements or components employed in the creation of desired images by electrophotographical processes, as will be known and understood by those skilled in the art. As will also be readily understood and appreciated by those skilled in the art, the method of the exemplary embodiment is equally well suited for use in a wide variety of imaging machines and is not necessarily limited in its application to the particular embodiment or embodiments depicted herein. Inasmuch as the art of electrophotographic printing is well known, the various elements and processing stations employed in the imaging machine 10 will be only briefly discussed herein.

In the illustrated embodiment, the imaging machine 10 includes a charge retentive surface member, such as rotating photoreceptor 12 in the form of a drum. Alternatively, the rotating photoreceptor could be a belt or other rotating device having a charge retentive surface. As known and understood by those skilled in the art, images can be created on the photoreceptor 12 and ultimately transferred from the photoreceptor 12 to print media, such as a sheet of paper. The term "print media" is used in connection with one or more exemplary embodiments discussed herein to generally refer to a usually flimsy physical sheet of paper, plastic, or other suitable physical print media substrate for images, whether precut or web fed.

Disposed about the photoreceptor 12 are various xerographic subsystems, including a cleaning device or station 14, a charging station 16, an exposure station 18, which forms a latent image on the photoreceptor 12, a developer 20 for developing the latent image by applying a toner thereto to form a toner image, a transferring unit, such as a transfer corotron 22, which transfers the toner image thus formed to the print media, and a fuser 24, which fuses the transferred image to the print media. In the illustrated embodiment, the fuser 24 is adapted to apply at least one of heat and pressure to the print media to physically and permanently attach the toner and optionally to provide a level of gloss to the printed media. In any particular embodiment of an imaging machine, there can be variations to that described above, such as, for example additional corotrons, cleaning devices, or, in the case of a color printer, multiple developers and/or multiple photoreceptor drums.

In operation, a portion of the drum 12 is charged to a relatively high, substantially uniform potential by the charging station 16 prior to entering the exposure area or station 18. At the exposure station 18, an imager, such as raster output scanner (ROS) 26, can selectively dissipate the charge, or, more specifically, portions of the charge, on the drum 12 for recording an electrostatic latent image on the drum which corresponds to a desired output image.

As is known and understood by those skilled in the art, an electronic subsystem (ESS) (illustrated schematically at 34) can be used to operate the ROS 26 and ultimately create desired electrostatic latent images on the drum 12. More specifically, the ESS 34 can receive information representative of the desired output image or images, such as a series of raster scan lines, and can use this information for creating the electrostatic latent image on the drum 12. As will be described in more detail below, the image signals transmitted to the ESS 34 may originate from a computer or other device connected, with wires or wirelessly, to the imaging machine 10 for communication therewith. Alternatively, the imaging machine 10 can include a raster input scanner (RIS), as described in more detail below. If the imaging machine 10 includes a RIS, an original document can be positioned in a document handler of the RIS and the RIS can include suitable components, such as illumination lamps, optics, a mechanical scanning drive, and a charge-coupled device (CCD) array), for capturing an entire original document (or documents) and converting the same to a series of raster scan lines to be transmitted to the ESS 34. Alternately, the ESS 34 can convert information sent by the RIS, or any other input device, into raster scan lines.

After the latent image has been recorded on the drum 12 from the information representative of the desired output image, the drum is rotated to advance the latent image to the developer 20. Using commonly known techniques, toner, in the form of liquid or dry particles, is electrostatically attracted to the latent image on the drum 12 at the developer 20. More particularly, the latent image attracts toner particles from the carrier granules forming a toner image thereon. After the electrostatic latent image is developed, the toner image present on the drum 12 is advanced to the transfer area or station 22.

Meanwhile, a print media sheet 40 is fed toward the transfer station 38 station 22 along sheet path 42, typically from the top of a stack 44 of print media sheets, as is known and understood by those skilled in the art. The stack 44 can be held in a storage member, such as tray 46 which can be removably mounted within the imaging machine. In the illustrated embodiment, the imaging machine 10 further includes a means or device (schematically illustrated at 48) for sensing the number of print media sheets remaining in the stack 44, either approximately or more exactly. The feeding of the print media sheet 40 along path 42 is timed so that the print media sheet 40 is at the transfer station 22 when the toner image formed on the drum 12 arrives at the transfer station 22. Specifically, the toner image contacts the advancing print media sheet 40 at the transfer station 22. The transfer station 22 can include a second corona generating device which sprays ions onto the back side of the print media sheet 40 to attract the toner image from the drum 12 to the print media sheet. Of course, as will be understood and appreciated by those skilled in the art, the transfer station 22 can include alternate means or devices for moving toner from the drum 12 to the print media sheet 40, such as, for example, bias transfer rolls or drums, or any other suitable device.

After transfer, the print media sheet 40 passes through the fuser 24 wherein the image is permanently fixed or fused to the print media sheet as is known and understood by those skilled in the art. The print media sheet 40 next moves along the path 42 to an output tray 52 where it can be retrieved from the machine 10. Of course, duplex operations could additionally be employed wherein the sheet could be inverted and then fed for recirculation back through the transfer station 36 and the fuser 44 for receiving and permanently fixing a side two image to the backside of that duplex sheet or, alternately, the sheet could be sent to a second imaging system and/or marking engine for further processing.

After the print media sheet 40 is separated from the drum 12, the residual toner/developer and paper fiber particles adhering to photoconductive surface of the drum 12 are removed therefrom by the cleaning station 14. As is known by those skilled in the art, the cleaning station 14 can include a rotatably mounted fibrous brush for contacting the drum 12 to disturb and remove paper fibers and a cleaning blade to remove any nontransferred toner particles. Subsequent to cleaning, an optional discharge lamp (not shown) floods the drum 12 with light to dissipate any residual electrostatic charge remaining thereon prior to the charging thereof for the next successive imaging cycle.

The various functions of the imaging machine 10 can be regulated by a controller, such as the ESS 34 or included within the ESS 34, as is known by those skilled in the art. The ESS 34 can be connected to the various components of the imaging machine 10 by suitable links 54 as is known and understood by those skilled in the art. The ESS 34 can beta programmable microprocessor which controls all of the machine functions hereinbefore described. As known and understood by those skilled in the art, the ESS 34 can be additionally linked to other components in the imaging machine 10, such as, for example, a print cartridge platform, a print driver, a function switch or switches, sensors, a self-diagnostic unit, etc., all of which can be interconnected by a suitable data/control bus. The control of all of the exemplary systems heretofore described may be accomplished by conventional control switch inputs from the printing machine consoles selected by the operator. Conventional sheet path sensors or switches may also be used to keep track of the position of the document and the copy sheets.

While the illustrated embodiment shows an electrophotographic imaging machine and particular reference herein is made to imaging machine 10 which includes an electrophotographic marking engine, suitable imaging machines capable of employing the method or methods of the exemplary embodiments described herein can alternatively include an ink-jet printer, including a solid ink type printer, a thermal head printer that is used in conjunction with heat sensitive paper, an offset press, a facsimile machine, an optical light lens copier and any other device capable of marking an image on a substrate. Although not illustrated, it is to be appreciated that the imaging machine 10 could be configured to employ duplex operations on print media sheet 40, wherein the sheet 40 could be inverted and then fed for recirculation back through the transfer station 22 and the fuser 24 for receiving and permanently fixing a side-two image to the backside of that duplex sheet. It should also be appreciated that imaging machine 10 need not be limited to a single print media tray, such as tray 46, or could alternatively have no tray wherein the imaging machine 10 could be fed by a separate feeder. For example, the imaging machine 10, could have two or more trays, such as trays for holding print media sheets of varying types (e.g., sizes, material, etc.).

Figure 2:
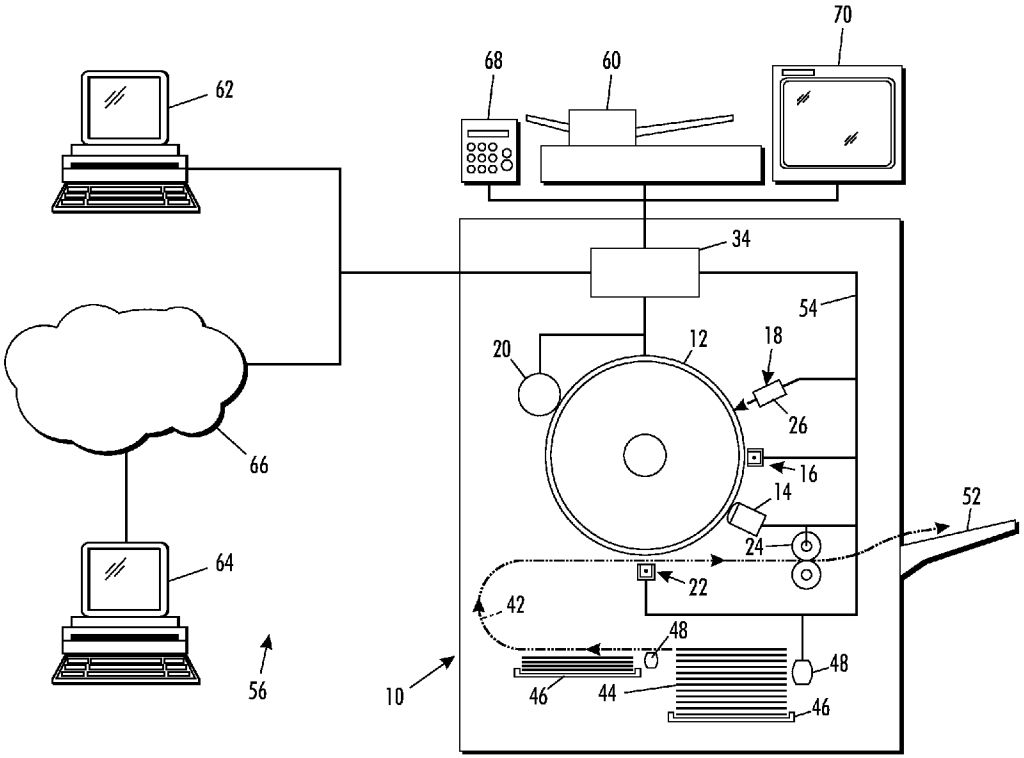
FIG. 2 is a schematic view of the imaging machine of FIG. 1 showing the machine optionally connected to one or more input and output devices.

With additional reference to FIG. 2, a printing system 56 is schematically shown including the imaging machine 10 linked or connected to one or more input and/or output devices, such as input/output devices 60, 62, 64, 66, and/or 68. As used herein, "linked" and/or "connected" are used broadly and can mean that one component is merely able to communicate with another component, via wires or wirelessly. It is to be appreciated by those skilled in the art that the imaging machine 10 need not be connected to all or any of the devices illustrated in FIG. 2. However, the imaging machine 10 can be connected to any of the illustrated input and output devices, described in more detail below, and such input and output devices need not be limited to those shown and/or described herein. For example, the input/output device can be a transportable memory card received in a part of the imaging machine 10.

In one exemplary embodiment, the imaging machine 10 can include, or at least be connected to for communication therewith, a raster input scanner (RIS) 60 wherein an original document or documents can be scanned and converted to a series of raster scan lines to be communicated to the ESS 34. Alternately, or in addition to, the imaging machine 10 and, more specifically, the ESS 34 of the imaging machine can be directly connected to a computer 62 or can be connected to one or more computers 64 through a network 66. From the computers 62,64 or the network 66, the ESS 34 can receive information representative of desired output images to be created by the imaging machine. Additionally, the imaging machine 10 can include or be directly connected to a keypad or keyboard 68, as well as a display screen 70, such as an LCD monitor.

Figure 3:
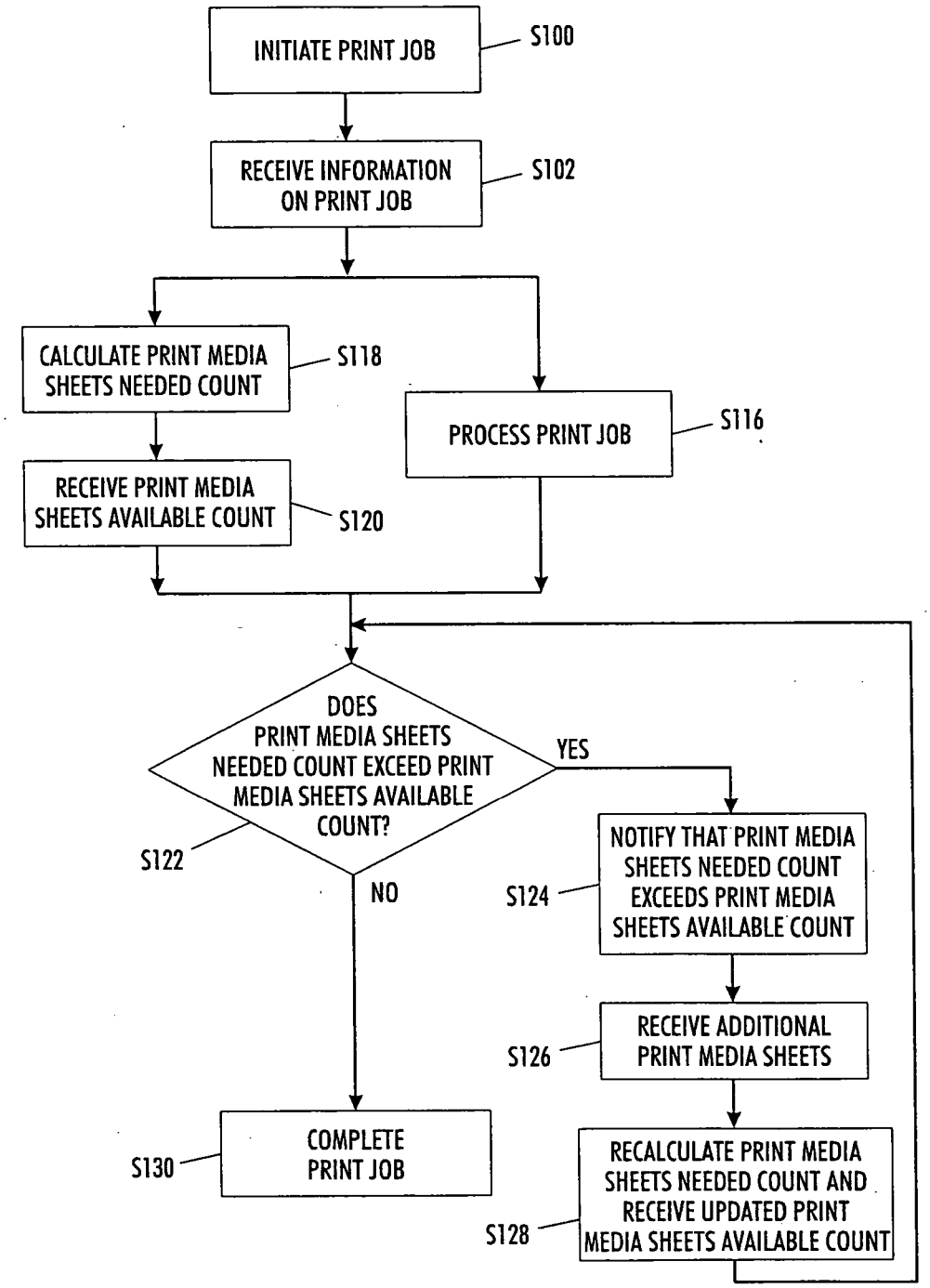
FIG. 3 is a flowchart illustrating one exemplary method of comparing calculated sheets needed against sheets available employable in the imaging machine of FIGS. 1 and 2.

With additional reference to FIG. 3, the block diagram therein depicts a method for a printing system, wherein a print media sheets needed count is compared to a print media sheets available count and is employable by the imaging machine 10 and/or the printing system of FIG. 2. As shown in FIG. 3, according to the method, a print job is initiated on the imaging machine 10 (step S100) through at least one input device communicating with the imaging machine. For example, when imaging machine 10 is employed as a printer connected to a computer 62 or 64 (i.e. one of the computers 62,64 serves as the at least one input device), step S100 typically begins when the user selects a print button or icon, such as from the print popup window on a connected computer 62 or 64. If imaging machine 10 is capable of functioning as a copier (i.e., includes means for scanning an original document and converting the same to raster lines, such as RIS 60, as the at least one input device), then step S100 could begin when the user depresses a start or copy button on the keyboard 68 of the imaging machine 10.

The term "print job" is used in connection with the one or more exemplary embodiments discussed herein to generally refer to a set of related sheets to be printed, usually one or more collated copy sets copied from a set of original document sheets or electronic document page images, from a particular user, or which are otherwise related. Each print job can, for example, include the number of print media sheets to be printed on, the size and type of each print media sheet to be printed on, whether simplex or duplex printing is required, etc. U.S. Pat. No. 5,710,635 to Webster, incorporated herein by reference, describes a representation of an example print job or document and how that representation can be transformed into something the imaging machine 10 can use to print the job. U.S. Pat. No. 5,604,600 to Webster and U.S. Pat. No. 5,129,639 to DeHority, both incorporated herein by reference, further describes example print job processing.

After initiating the print job, the ESS 34 receives information from the input device used to initiate the print job, wherein the received information corresponds to the print job (step S102). Thus, for example, if the print job is initiated from one of the computers 62,64 as the input device, the ESS 34 receives information corresponding to the print job from the computer 62 or 64. If the print job is initiated from RIS 60 as the input device, the ESS 34 receives information corresponding to the print job from the RIS 60. Similarly, in alternate embodiments, if the at least one input device is some other type of device, such as a transportable memory device combined with the keypad 68, the information corresponding to the print job is received by the ESS 34 from one or both of these devices.

Figure 4:
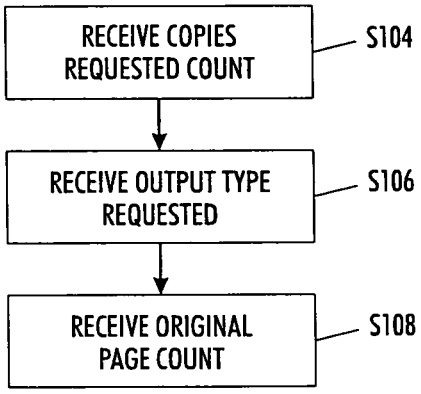
FIG. 4 is a flowchart illustrating one exemplary set of steps for receiving information corresponding to a print job.

The steps of initiating the print job (S100) and receiving information corresponding to the print job (S102) can include one or more of the following substeps illustrated in FIG. 4, namely, receiving a copies requested count corresponding to the print job (S104), receiving an output type requested corresponding to the print job (S106), and/or receiving an original page (or sheet) count corresponding to the print job (S108). Each of the substeps S102, S106 and S108 are received by the ESS 34 from the input device (or devices) used to initiate the print job and from which information corresponding to the print job is received. As described in more detail below, the substep of receiving the output type requested can involve ripping (i.e., raster image processing) of a document to be provided wherein the ripping determines a number of pages to be produced.

More particularly, the copy count is the number of copies desired of a particular print job. The copy count is usually entered by a user directly into the imaging machine 10, such as through keyboard 68, or into a computer 62 or 64 connected to the imaging machine via a keyboard of the computer, such as in a conventional print popup window displayed on the computer's monitor. The copy count is communicated to the ESS 34 from the input device employed to enter the same.

The output type requested can be, for example, an indication of whether the print job output is to be one-sided or two-sided. Alternatively, the output type requested can be some other number of pages of the original document per output sheet, such as when printing a number of presentation slides to single output sheets, printing in booklet form, n-up printing, etc. The output type requested, like the copy count, is typically entered by a user directly into the imaging machine 10 via keyboard 68 or into a connected computer 62 or 64 immediately prior to selecting a print button. Like the copy count, the output type requested is communicated to the ESS 34 by the input device used to initiate the print job.

Figure 5:
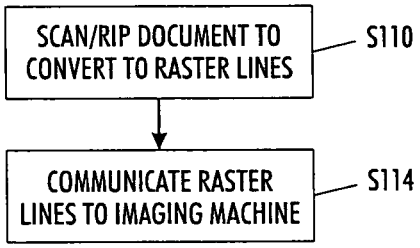
FIG. 5 is a flowchart illustrating one exemplary set of steps for initiating a print job.

When the print job is initiated (step S100), the machine 10 can count the number of sheets or pages of the original document or documents to be printed (S108). Alternatively, the number of pages or sheets to be printed can be counted externally and the count delivered to the machine 10. Functioning as a printer, machine 10 counts or has communicated thereto the number of sheets or pages ripped. Ripping can occur separately from the imaging machine 10, within the imaging machine 10 or in combination with the imaging machine 10 and another device. Optionally, the print job can be delivered to the imaging machine 10 in a print ready format, such as pdf or PostScript file, and no ripping necessary. Alternatively, functioning as a copier, imaging machine 10 counts the number of pages or sheets scanned by the RIS 60 for copying. In either case, the original page count of the print job is received by the ESS 34. More specifically, with additional reference to FIG. 5, the step of initiating the print job can include the substeps of ripping a document to be printed (S110), converting the ripped document to raster lines (S112), and communicating the raster lines to the ESS 34 (S114), particularly when the print job is generated from a computer generated image or document. When a copy of a document is being made, the substeps of initiating the print job can include scanning an original document (S110), converting the scanned original document to raster lines (S112), and communicating the raster lines to the ESS 34 (S114). From the substeps of scanning the original document or ripping a document to be printed, the original page count is determined and received by the ESS 34.

Processing of the print job (step S116) can occur as described hereinabove and results with actual printing of desired images on print media sheets from the stack 42 of print media sheets. Simultaneous with processing of the print job, the imaging machine 10 can calculate the print media sheets needed count for the print job (step S118). Calculating the number of sheets needed can be done in one exemplary example as follows: if one-sided, one-up output is selected (and received in substep S106), the imaging machine 10 calculates the sheets needed count as being the number of pages in the original document (received in substep S108) multiplied by the number of copies requested (received in step S104); and, if two-sided output is selected (received in step S106), the imaging machine 10 calculates the number of sheets required as the number of pages in the print job document (received in step S108) multiplied by the number of copies requested (received in step S104) divided by two (for two-sided output). As will be understood and appreciated by those skilled in the art, when two-sided output is selected, only half the number of sheets are needed for the job. Of course, the output type requested can further alter the calculation. For example, if booklet-type printing is desirable, then essentially four pages of the print job are to be printed on each print media sheet of the stack 42 and the calculated number of sheets needed is reduced by a factor of four (4). Calculation of the number of sheets needed is done by the ESS 34.

Next, the number of print media sheets available is acquired or determined (step S120). In the imaging machine 10, for example, stack 42 is held in print media sheet tray 46 and sensing device 48 can be employed to determine the number of sheets remaining in the tray 46. The sensing device 48 can be a level sensor or a more precise sheet counter. As is known, level sensors in trays holding the stack or stacks of print media sheets can provide an approximate count of the number of sheets remaining. In alternate embodiments, a more accurate count of the number of sheets available in a print media sheet supply tray can be made, such as when the exact thickness of each print media sheet is known and stack height is measured or if print media sheet counting algorithms are used in conjunction with other level sensors. One exemplary sheets available system and method is disclosed in U.S. Pat. No. 4,835,573, expressly incorporated herein by reference.

As will be understood and appreciated by those skilled in the art, any means or device for determining the number of print media sheets remaining can be employed and sensing device 48 is contemplated as encompassing all such sensing means and/or devices. In any case, the sensing device 48 communicates the number of print media sheets available to the ESS 34. In alternate embodiments, the sheets available could be known without use of a sensing device. For example, the number of sheets initially available could be input by a user when loading a paper tray and the imaging machine could maintain a count of the sheets used and compare this count against the sheets available input by the use to determine the actual sheets available as print jobs are processed.

When the imaging machine 10 calculates the number of sheets needed for the print job (step S118), it (specifically, the ESS 34) compares this number (in step S122) with the count of the number of sheets available or remaining (from step S120). When the number of sheets required for a print job exceeds the number of print media sheets available, an indication or notification can be provided to the user (step S124). For example, the imaging machine 10 can display a warning to the user indicating that the user should add more print media sheets to the supply tray 46 to complete the print job in step S116. The display can, for example, occur on display screen 70, via a light or other indicator on the imaging machine 10, and/or on a connected computer 62 or 64. This can be particularly advantageous if provided before the imaging machine is forced to stop for lack of available print media sheets because the user is then given an opportunity to replenish the print media sheets prior to a stoppage of the print job.

Should more print media sheets be necessary, after an indication in step S124, the imaging machine 10 can receive additional print media sheets (step S126). Should additional print media sheets be added in step S126, the print media sheets needed count is recalculated and an updated print media sheets available count is received (step S128). More specifically, the recalculated print media sheets needed count is the previous number of print media sheets needed less the number of sheets printed in the print job. The updated print media sheets available count includes the sheets added in step S126. When a sufficient number of print media sheets remain in the tray 46, such that no indication is given in step S124 or one or more re-supplies of the tray 46 in step S126 after an indication in step S124, the machine 10 can finish the print job (step S130).

In alternate embodiments, the exemplary method described herein could be employed in imaging machines having or being fed from multiple print media sheet trays or bins. In such alternate embodiments, the notification in step S124 could specify the tray that is in use and/or specify the specific tray or trays to which additional print media sheets should be added. In imaging machines employing multiple trays and auto tray switching, the sheets available could be calculated from all available or appropriate trays and the notification in step S124 could specify which tray to which print media sheets should be added and/or could specify a preferred or most empty tray to which print media sheets should be added.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A method for a printing system, comprising:

initiating a print job on an imaging machine through at least one input device communicating with said imaging machine;

printing output related to said print job from a first tray included as one of multiple trays;

simultaneously calculating a combined total print media sheets available number in the multiple trays;

simultaneously calculating a print media sheets needed value to complete said print job, said sheets needed value is based on at least a number of pages needed for producing the output of the print job;

comparing said sheets available value with said sheets needed value; and, if said sheets needed value is greater than said sheets available value, specifying at least a second tray for replenishment in which additional print media sheets can be added while the imaging machine executes print output from said first tray.

2. The method of claim 1, wherein said step of calculating said sheets needed value further includes:

multiplying the number of pages by a number of copies requested from said at least one input device; and, dividing the number of pages by 2 if a double-sided output type is requested from said at least one input device.

3. The method of claim 1, wherein said step of comparing said sheets needed value against said sheets available value occurs during said step of processing said print job and prior to depletion of said plurality of print media sheets.

4. The method of claim 1 wherein said step of initiating said print job through said at least one input device includes:

scanning an original document to convert said scanned original document to raster lines; and communicating said raster lines to an electronic subsystem of said imaging machine.

5. The method of claim 4 further including receiving an original page count from said step of scanning said original document.

6. The method of claim 1 wherein said step of initiating said print job through said at least one input device includes:

ripping a document to be printed to convert said document to raster lines; and communicating said raster lines to an electronic subsystem of said imaging system.

7. The method of claim 6 further including receiving an original page count from said step of ripping said document to be printed.

8. The method of claim 1 wherein said at least one input device includes at least one of:

a keypad disposed on or in communication with said imaging machine;

a facsimile machine in communication with said imaging machine;

a computer in communication with said imaging machine; and a raster input scanner disposed on or in communication with said imaging machine.

9. The method of claim 1 wherein said at least one output device includes at least one of:

a display screen disposed on or in communication with said imaging machine;

an indicator light; and a computer in communication with said imaging machine.

10. The method of claim 1 further including a step of receiving additional print media sheets when said print media sheets needed count exceeds said print media sheets available count to complete said print job prior to stoppage of said print job.

11. A method for comparing calculated sheets needed against sheets available, comprising:

initiating a print job on an imaging machine through at least one input device communicating with said imaging machine;

starting printing output related to said print job from a first tray included as one in multiple trays;

simultaneously calculating a combined total print media sheets available count in multiple trays;

simultaneously calculating a print media sheets needed count to complete the print job, said sheets needed value is based on at least a number of pages needed for producing the output of the print job;

determining if the sheets available count is less than the sheets needed count;

if the determination is positive, specifying a tray for replenishment in which additional print media sheets can be added while said imaging machine executes said print output from another tray.

12. The method of claim 11 wherein said step of determining whether said print media sheets available count is less than said print media sheets needed count includes a sub-step of comparing said print media sheets needed count against said print media sheets available count.

13. The method of claim 11 further including a step of notifying a user through at least one output device communicating with said imaging machine that said print media sheets needed count exceeds said print media sheets available count simultaneous with said processing of said print job.

14. The method of claim 11 further including a step of receiving additional print media sheets when said print media sheets needed count exceeds said print media sheets available count to complete said print job prior to stoppage of said print job.

15. The method of claim 11, wherein the number of pages needed for producing the output of the print job is automatically determined.

16. A method for a printing system, wherein a print media sheets needed count is compared to a print media sheets available count, the method comprising:

initiating a print job on an imaging machine through at least one input device communicating with said imaging machine;

printing output related to said print job from a first tray included as one of multiple trays;

simultaneously calculating a combined total print media sheets available number in the multiple trays;

simultaneously calculating a print media sheets needed value to complete said print job, said sheets needed value is based on at least a number of pages needed for producing the output of the print job;

comparing said sheets available value with said sheets needed value; and, if said sheets needed value is greater than said sheets available value, notifying a user through at least one output device that said first tray needs replenishment.

17. The method of claim 16, further including:

multiplying the number of pages by a number of copies requested from said at least one input device; and, dividing the number of pages by 2 if a double-sided output type is requested from said at least one input device.

* * * * *